United States Patent [19]

Kikuchi et al.

[11] 4,041,428

[45] Aug. 9, 1977

[54] DEFLECTION YOKE FOR USE WITH IN-LINE CATHODE RAY TUBES

[75] Inventors: Yasuo Kikuchi; Yasuyuki Ohmichi, both of Yokohama; Osamu Terasaki; Koichi Sakai, both of Tokyo, all of Japan

[73] Assignee: Sony Corporation, Tokyo, Japan

[21] Appl. No.: 719,101

[22] Filed: Aug. 31, 1976

[30] Foreign Application Priority Data

Sept. 2, 1975 Japan ..... 50-106154

[51] Int. Cl.[2] ..... H01F 7/00

[52] U.S. Cl. ..... 335/210; 335/213

[58] Field of Search ..... 335/210, 212, 213

[56] References Cited

U.S. PATENT DOCUMENTS

| | | | |
|---|---|---|---|
| 3,652,966 | 3/1972 | Meier | 335/213 X |
| 3,829,806 | 8/1974 | Lathouwers et al. | 335/210 |
| 3,849,749 | 11/1974 | Kadota | 335/210 |

*Primary Examiner*—George Harris
*Attorney, Agent, or Firm*—Lewis H. Eslinger; Alvin Sinderbrand

[57] ABSTRACT

A deflection yoke for use with an in-line cathode ray tube in which a plurality of electron beams are laid, for example, in a horizontal plane, which has a horizontal deflection winding formed in the saddle shape with front and rear bends for producing a pincushion type magnetic field and a vertical deflection winding wound toroidally around a magnetic core to surround the horizontal deflection winding between the front and rear bends for producing a barrel type magnetic field, wherein the vertical deflection winding is shorter than the distance between the front and rear bends of the horizontal deflection winding and is positioned adjacent the front bend and with a predetermined space from the rear bend. The use of the deflection yoke with the in-line cathode ray tube can eliminate or simplify a dynamic convergence correcting device.

6 Claims, 17 Drawing Figures

DEFLECTION YOKE FOR USE WITH IN-LINE CATHODE RAY TUBES

BACKGROUND OF THE INVENTION

1. Field of the Invention

This invention relates generally to a deflection yoke for use with a color cathode ray tube to deflect electron beams generated therein, and more particularly to such a deflection yoke which is aimed to be use with an in-line multibeam cathode ray tube for omitting or simplifying a dynamic convergence correcting means.

2. Description of the Prior Art

Recently, a color cathode ray tube in which a plurality of electron beams are laid in a plane, namely, an in-line cathode ray tube has been actively employed. With the in-line cathode ray tube, a deflection yoke having a horizontal deflection winding which produces a horizontal magnetic field of the pincushion type and a vertical deflection winding which produces a vertical magnetic field of the barrel type is usually used for mitigating misconvergence of the electron beams. For such a deflection yoke, the combination of a saddle shaped horizontal deflection winding and a toroidal vertical deflection winding is popular.

The use of the above mentioned deflection yoke with the in-line cathode ray tube, however, still causes the misconvergence, especially at peripheral portions of a screen of the cathode ray tube. For example, when the beams laid in a line which are properly converged at a central portion of the screen are horizontally deflected, the space between the beam spots on the screen gradually increases in proportion as the deflection angle of the beam increases and, as a result at both side portions on the screen the misconvergence which is not much to be ignored arises. To avoid this misconvergence, generally, a dynamic convergence correcting device has been provided in addition to the reflection yoke. Such a correcting device is, however, so troublesome to adjust or control and besides results in increased cost. Further, some deflection yokes have been proposed for deflecting the beams laid in a line with proper convergence at the whole area of the screen without the use of the dynamic convergence correcting device. Such deflection yokes have the horizontal and vertical windings both of which are wound toroidally with specially arranged winding distribution and therefore the yokes are hard to be manufactured.

SUMMARY OF THE INVENTION

An object of the present invention is to provide an improved deflection yoke of the type having a pair of deflection windings one of which is wound toroidally and the other of which is wound in the saddle shape.

Another object of the present invention is to provide an improved deflection yoke of the type having a pair of windings of the toroidal type and the saddle shaped type, respectively, for use with in-line cathode ray tubes to omit or simplify a dynamic convergence correcting means.

A further object of the present invention is to provide a deflection yoke having a toroidal vertical deflection winding and a saddle shaped horizontal winding for use with cathode ray tubes in which plural electron beams are laid in a line horizontally to eliminate a dynamic convergence correction device.

Other objects, features and advantages of the present invention will be apparent from the following description taken in conjunction with the accompanying drawings.

DESCRIPTION OF THE PREFERRED EMBODIMENT

In order to better understand the present invention, a prior art deflection yoke will be described with reference to FIGS. 1 to 6.

Figure 1:
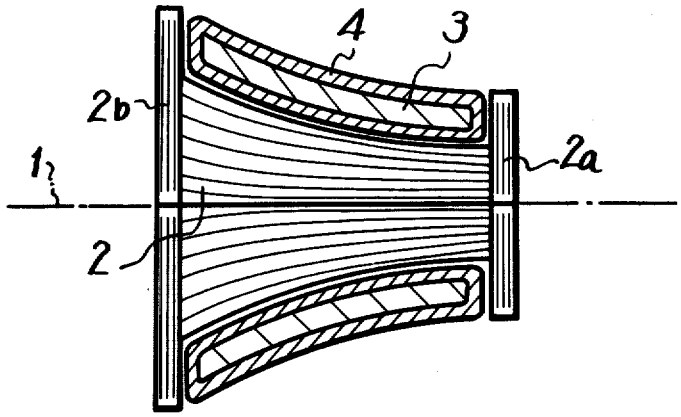
Fig. 1 (PRIOR ART)
FIG. 1 is a schematic view showing a conventional deflection yoke.
Figure 4:
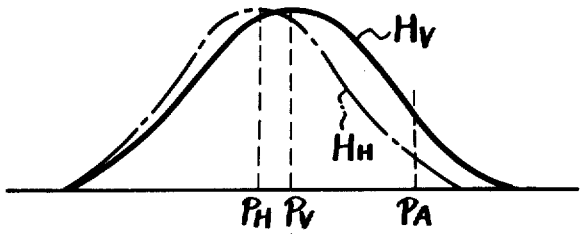
Fig. 4 (PRIOR ART)
FIG. 4 is a schematic diagram showing the distribution of magnetic field of the conventional deflection yoke.

In the prior art deflection yoke, as shown in FIG. 1 in cross-section, a horizontal deflection winding 2 wound in a saddle shape is mounted on a cathode ray tube not shown between its neck portion and funnel portion, a magnetic core 3 is located on the outer side of the horizontal deflection winding 2, and further a vertical deflection winding 4 is wound on the core 3 in the toroidal shape which is located outside the winding 2, respectively. The length of the vertical deflection winding 4 in an axial direction 1 of the cathode ray tube is selected substantially equal to the distance between a rear bend 2 *a* of the horizontal deflection winding 2 at the side to a cathode of the cathode ray tube where electron beams are emitted (beam emitting side) and a front bend 2*b* of the horizontal deflection winding 2 at the side to a screen of the cathode ray tube.

Figure 2:
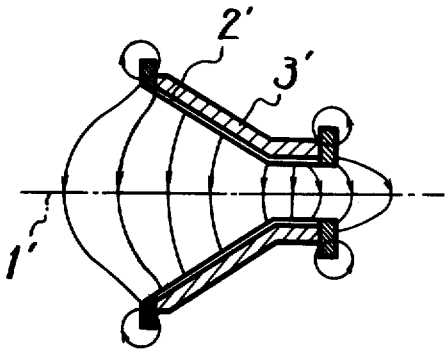
Fig. 2 (PRIOR ART)
FIGS. 2 and 3 are schematic sectional views of deflection windings used for explanation of the magnetic field produced by the conventional deflection yoke.
Figure 3:
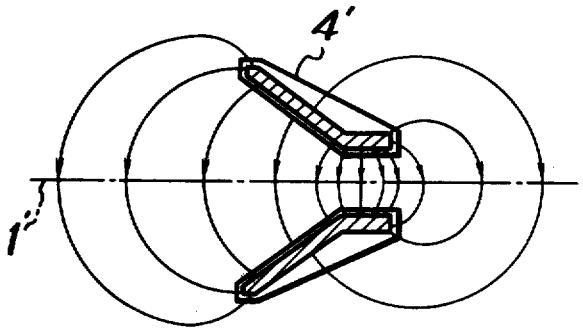
Fig. 3 (PRIOR ART)

In general, magnetic fields produced by a winding of the saddle type and a winding of the toroidal type are shown in FIGS. 2 and 3, respectively. The magnetic field produced by a winding 2' of the saddle type is not so expanded in an axial direction 1' of the cathode ray tube as shown in FIG. 2, but the magnetic field produced by a winding 4' of the toroidal type is extended to the front and back of the winding 4' in the axial direction 1' of the cathode ray tube as shown in FIG. 3. In FIG. 2, 3' designates a core. For this reason, the distribution of magnetic fields of the deflection yoke shown in FIG. 1 becomes such that a peak position $P_V$ of the vertical deflection magnetic field $H_V$ is located near the beam emitting side as compared with a peak position $P_H$ of a horizontal deflection magnetic field $H_H$, and at an inner position $P_A$ of the rear bend $2_a$ of the horizontal deflection winding 2 at the beam emitting side the vertical deflection magnetic field $H_V$ is greater than the horizontal deflection magnetic field $H_H$. As a result, at the position $P_A$ the deflection width of the beams in the vertical direction becomes greater than that of the beams in the horizontal direction.

Figure 5:
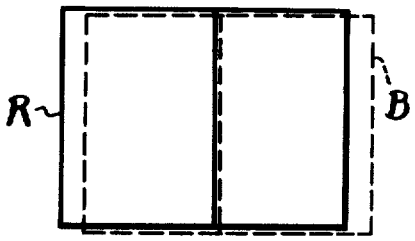
Fig. 5 (PRIOR ART)
FIGS. 5 and 6 are schematic illustrations used for explanation of the condition of beam convergence.
Figure 6:
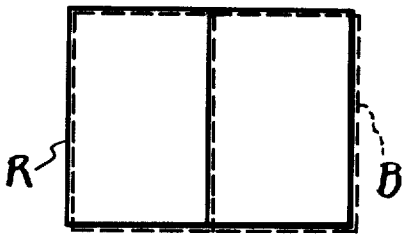
Fig. 6 (PRIOR ART)

If the above mentioned prior art deflection yoke is used in an in-line color cathode ray tube in which beams are laid in a plane or in-line in horizontal direction, there is caused misconvergence that the landing spots of the respective beams, for example, red and blue beams R and B become more apart with each other as they approach the left and right peripheries of the screen of the color cathode ray tube as shown in FIG. 5. In order to correct or mitigate such a mis-convergence, beam deflection control with a parabolic signal of the horizontal period is employed in the prior art. Thus, the misconvergence shown in FIG. 5 is corrected as shown in FIG. 6.

For example, with the prior art such a manner is generally employed that a convergence yoke is located around the neck portion of the cathode ray tube and a parabolic wave current is fed to the convergence yoke to produce a correction magnetic field and to control the beams therewith.

Figure 9:
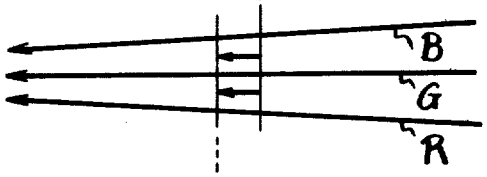
FIG. 9 is a schematic illustration used for explaining the difference in operation between the conventional deflection yoke and the deflection yoke of the present invention.
Figure 8:
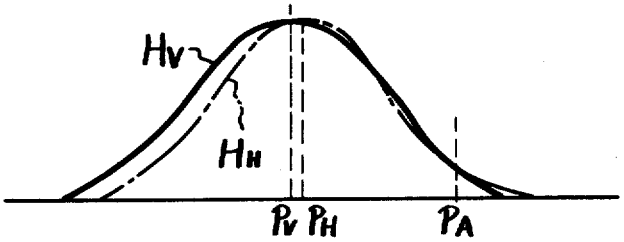
FIG. 8 is a schematic diagram showing the distribution of magnetic field of the deflection yoke according to the present invention.
Figure 7:
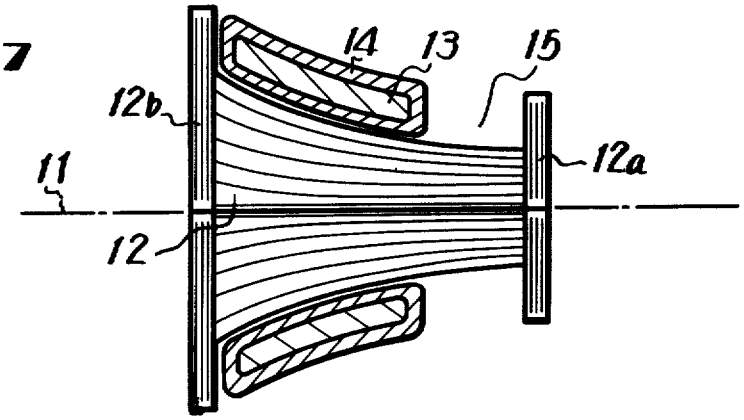
FIG. 7 is a schematic view showing a deflection yoke according to the present invention.

An embodiment of the deflection yoke according to the present invention for use with, especially an in-line cathode ray tube is shown in FIG. 7. As may be apparent from FIG. 7, a horizontal deflection winding 12 wound in the saddle shape is mounted on a cathode ray tube (not shown) between its neck portion and funnel portion, and at the outside thereof a core 13 is disposed on which a vertical deflection winding 14 wound in the toroidal shape is mounted. In this case the length of the core 13 and vertical deflection winding 14 in an axial direction 11 of the cathode ray tube is selected shorter than the length of the horizontal deflection winding 12 between a bend portion at the side to the cathode of the cathode ray tube or rear bend $\mathbf{12}_a$ and a bend portion at the side of the screen of the cathode ray tube or front bend $\mathbf{12}_b$, and the core 13 with the winding 14 is located near the front bend $\mathbf{12}_b$ to provide a sufficient space or clearance 15 between the rear end of the core 13 and the rear bend $\mathbf{12}_a$ of the horizontal deflection winding 12 which is the main constructional feature of the present invention. In this case, the front bend $\mathbf{12}_b$ of the horizontal deflection winding 12 has a larger diameter than the rear bend $\mathbf{12}_a$ thereof. With the deflection yoke of the invention having the above constructional feature, the distribution of magnetic fields in the axial direction 11 of the cathode ray tube becomes such that a peak position $P_V$ of the vertical deflection magnetic field $H_V$ becomes close to that $P_H$ of the horizontal deflection magnetic field $H_H$ or approaches the screen side beyond the peak position $P_H$ as shown in FIG. 8. Accordingly, the vertical deflection magnetic field $H_V$ exert on the beams as a whole, at a position near the screen where the distances between adjacent beams, for example, between the beams R and G and between the beams G and B narrower, as shown in FIG. 9, and the horizontal deflection magnetic field $H_H$ becomes equal to or greater than the vertical deflection magnetic field $H_V$ at the inner position $P_A$ of the rear bend $\mathbf{12}_a$ of the horizontal deflection winding 12. Hence, at the position $P_A$ the deflection width of the beams in the horizontal direction becomes equal to or greater than that of the beams in the vertical direction. Further, in this case the horizontal deflection magnetic field $H_H$ produced by the horizontal deflection winding 12 is made high in pincushion degree as compared with the prior art horizontal deflection magnetic field $H_H$, and the vertical deflection magnetic field $H_V$ produced by the vertical deflection winding 14 is made high in barrel degree as compared with the prior art vertical deflection magnetic field $H_V$.

Figure 10:
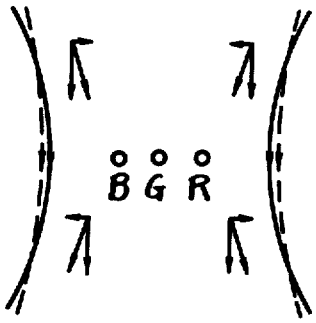
FIGS. 10 to 15 are schematic illustrations used for explanation of the operation of the deflection yoke according to the present invention.
Figure 11:
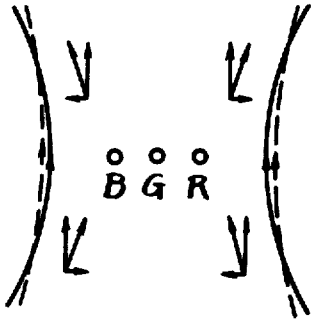
Figure 12:
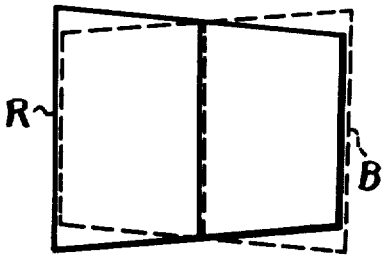

By the way, if in the prior art deflection yoke shown in FIG. 1 the horizontal deflection magnetic field $H_H$ is made higher in pincushion degree, or the horizontal deflection magnetic field is changed from the state indicated by a broken line to the state indicated by a solid line in FIG. 10 when the beams R, G and B scan the left half of the screen and from the state indicated by a broken line to the state indicated by a solid line in FIG. 11 when the beams R, G and B scan the right half of the screen where the front surface of the sheet of FIGS. 10 and 11 is taken as the screen side, respectively, the vertical components of the magnetic field for the beams R and B at the both sides are decreased but the horizontal components of the magnetic field on the contrary, are increased. Thus, the misconvergence in the horizontal direction can be corrected but a cross-misconvergence in the vertical direction is newly caused as shown in FIG. 12.

Figure 15:
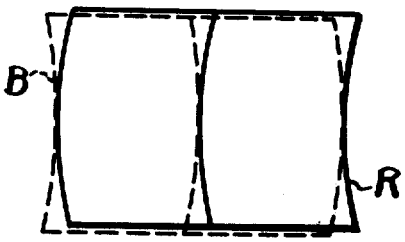
Figure 13:
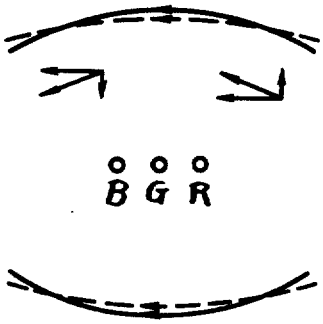
Figure 14:
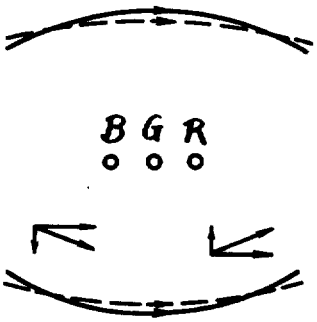

If in the prior art deflection yoke shown in FIG. 1 the vertical deflection magnetic field $H_V$ is made higher in barrel degree or the vertical deflection magnetic field is changed from the state indicated by a broken line to the state indicated by a solid line in FIG. 13 when the beams R, G and B scan the upper half of the screen and from the state indicated by a broken line to the state indicated by a solid line in FIG. 14 when the beams R, G and B scan the lower half of the screen where the front surface of the sheet of FIGS. 13 and 14 is taken as the screen side, respectively, the horizontal components of the magnetic field for the beams R and B at the both sides are decreased but the vertical components of the magnetic field, on the contrary, are increased. Thus, the cross-misconvergence in the vertical direction can be corrected but a bow shaped misconvergence in the horizontal direction different from that shown in FIG. 5 is newly caused as shown in FIG. 15. In other words, if it is designed, in the prior art deflection yoke that the horizontal deflection magnetic field becomes higher in pincushion degree and the vertical deflection magnetic field becomes higher in barrel degree, there is caused a bow shaped misconvergence that the landing spot of the beam R is moved to the right as the beam R approaches the upper and lower edges of the screen and the landing spot of the beam B is moved to the left as the beam B approaches the upper and lower edges of the screen as shown in FIG. 15.

With the deflection yoke of the present invention, as described above, the horizontal deflection magnetic field is made higher in pincushion degree and the vertical deflection magnetic field is made higher in barrel degree, the length of the vertical deflection winding 14 in the axial direction 11 of the cathode ray tube is selected shorter than the distance between the rear and front bends $\mathbf{12}_a$ and $\mathbf{12}_b$ of the horizontal deflection winding 12, and the vertical direction winding 14 is displaced near the front bend $\mathbf{12}_b$ to form the space 15 between its rear end and the rear bend $\mathbf{12}_b$ as shown in FIG. 7. Therefore, as shown in FIG. 9, the vertical deflection magnetic field acts generally on the respective beams near the screen where the distances between adjacent beams are shortened. As a result, even though the vertical deflection magnetic field itself is not changed in magnitude, its deflection force exerting on the beams is decreased. Accordingly, the deflection force of the vertical deflection magnetic field to deflect the left and right beams B and R in opposite directions in the horizontal direction as they approach the uper and lower edges of the screen as shown in FIGS. 10 and 11, which force is caused by the fact that the vertical deflection magnetic field is made high in barrel degree, is decreased, and due to the fact that the distribution of the vertical deflection magnetic field in the axial direction of the cathode ray tube is displaced suitably, the beams can be brought into their correct convergence without the appearance of misconvergence shown in FIG. 15.

According to experiments, when the length of the vertical deflection winding 14 in the axial direction 11 of the cathode ray tube is selected about 55 to 70 percent of the distance between the rear and front bends $12_a$ and $12_b$ of the horizontal deflection winding 12 and hence the length of the space 15 in the axial direction 11 is about 30 to 45 percents of the distance between the bends $12_a$ and $12_b$, the deflection width of the beams in the horizontal direction becomes greater than that of the beams in the vertical direction at the inner position $P_A$ of the rear bend 12a. When the direction width of the beams in the horizontal direction is longer than that of the beams in the vertical direction at the inner position $P_A$ of the rear bend $12_a$, it is ascertained that there is caused no misconvergence.

Figure 16:
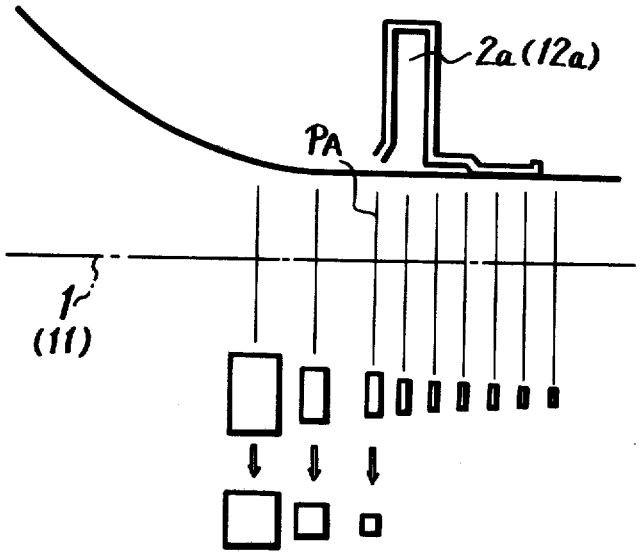
FIGS. 16 and 17 are schematic illustrations used for explaining the deflection yoke of the present invention in comparison with the conventional deflection yoke.

FIG. 16 is a schematic view illustrating the state of the deflection width of the beams. With the prior art deflection yoke, the deflection width of the beam in the vertical direction is longer than that in the horizontal direction at the inner position $P_A$ of the year bend $2_a$ of the horizontal deflection coil and also near the position $P_A$ as shown by rectangles in the vertical direction in FIG. 16.

With the deflection yoke of the present invention, on the contrary the deflection width of the beam in the horizontal direction is equal to or longer than that of the beam in the vertical direction at the inner position $P_A$ *of the rear bend* $12_a$ of the horizontal deflection winding 12 as shown by rectangles indicated by arrows in FIG. 16. In this case, the aspect ratio of a raster on the screen is, of course, selected as 3:4 as in the case where the prior art deflection yoke is used.

Figure 17:
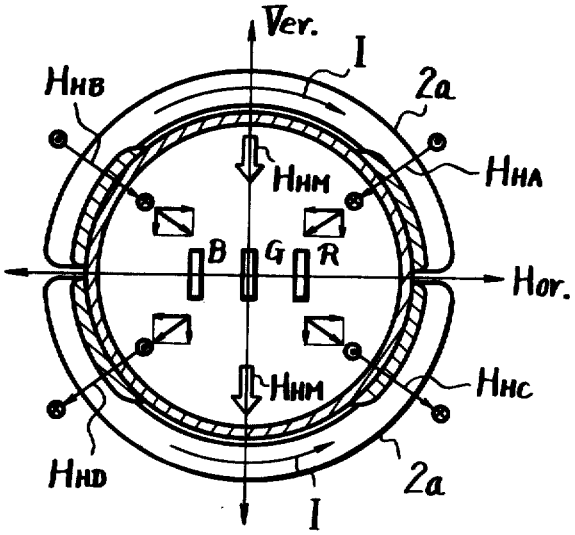

If the deflection width of the beam in the vertical direction is shorter than that of the beam in the horizontal direction at the inner position $P_A$ of the rear bend $12_a$ of the horizontal deflection winding 12 as in the deflection yoke of the present invention, the influence by the bends can be reduced. That is, FIG. 17 shows the horizontal deflection magnetic field produced by the prior art horizontal deflection winding 2 at the inner position $P_A$ of the rear bend $2_a$ which is viewed from the screen side of the cathode ray tube. In this case, a main magnetic field $H_{HM}$ in the vertical direction is produced by a current flowing through the portion coupling the upper and lower bends $2_a$ and the beams are deflected in the horizontal direction by this main magnetic field $H_{HM}$. Further, by a current I flowing through the bends $2_a$ there are produced magnetic fields which surround the bends $2_a$. The latter magnetic fields become those $H_{HA}$ to $H_{HD}$ which are directed to the axis of the cathode ray tube or originated therefrom at the inner position $P_A$. These magnetic fields $H_{HA}$ to $H_{HD}$ are cancelled one another for the center beam G and hence have almost no affect on the center beam G. However, when the deflection widths of the side beams B and R are great, respectively, as shown in FIG. 17, they are affected by the magnetic fields $H_{HA}$ to $H_{HD}$. That is, the magnetic fields $H_{HA}$ to $H_{HD}$ are divided into horizontal and vertical components, respectively. The vertical components of the magnetic fields $H_{HA}$ to $H_{HD}$ are absorbed by the main magnetic field $H_{HM}$, but their horizontal components apply forces to the beams R and B in opposite directions when the beams R and B scan the upper and lower halves of the screen as shown in FIG. 17. That is, the horizontal components of the magnetic fields $H_{HA}$ to $H_{HD}$ act on the beams R and B to cause the cross-misconvergence in the vertical direction as shown in FIG. 12.

With the deflection yoke of the present invention, however, since the deflection width of the beam in the vertical direction is small at the inner position $P_A$ of the rear bend 12, the beams are almost free from the affect of the horizontal components of the magnetic fields $H_{HA}$ to $H_{HD}$ and hence they have almost no act on the beams to cause the cross-misconvergence in the vertical direction.

As described above, the deflection yoke of the present invention is simple in construction, easy in manufacture and produce a picture with no misconvergence without any dynamic convergence correction by the parabolic signal.

The above description is given on the case that the deflection yoke of the present invention is applied to an in-line cathode ray tube in which a plurality of beams is laid in a plane or an in-line in the horizonntal direction. On the other hands, when the deflection yoke of the invention is applied to an in-line cathode ray tube in which a plurality beams are laid in an in-line in the vertical direction, it may be sufficient that the horizontal deflection winding and the vertical deflection winding are inter-changed with each other. Thus, this latter case should be also included in the scope of the present invention.

It will be apparent that many modifications and variations could be effected by one skilled in the art without departing from the spirits or scope of the novel concepts of the present invention, so that the scope of the invention should be determined by the appended claims only.

We claim as our invention

1. A deflection yoke for use with an in-line cathode ray tube in which a plurality of electron beams are laid in a plane, said deflection yoke comprising:

a. a first deflection winding formed in the saddle shape with front and rear bends at both end portions thereof, through which the electron beams pass from said rear bend to said front bend when the deflection yoke is mouned on the cathode ray tube;

b. a magnetic core disposed to surround said frist deflection winding between said front and rear bends; and c. a second deflection winding would toroidally around said magnetic core so as also to surround said first deflection winding between said front and rear bends, said second deflection winding being shorter than the distance between said front and rear bends of the first deflection winding and being positioned adjacent said front bend of the first deflection winding at one end thereof and with a predetermined space between the other end thereof and said rear bend of the first deflection winding.

2. A deflection yoke according to claim 1, wherein said first and second deflection windings are a horizontal deflection winding and vertical deflection winding, respectively.

3. A deflection yoke according to claim 2, wherein said horizontal deflection winding is arranged to produce a pincushion type magnetic field and said vertical deflection winding is arranged to produce a barrel type magnetic field.

4. A deflection yoke according to claim 3, wherein said predetermined space between the other end of the vertical deflection winding and the rear bend of the horizontal deflection winding is selected about 30 to 45 percent of the distance between the front and rear bends of the horizontal deflection winding.

5. A deflection yoke according to claim 4, wherein said front bend of the horizontal deflection winding has a larger diameter than said rear bend of the horizontal deflection windings.

6. A deflection yoke according to claim 3, wherein said horizontal and vertical deflection windings produce a composite magnetic field by which the electron beam is deflected in the condition that a vertical deflection width is not wider than a horizontal deflection width at the position of the rear bend of the horizontal deflection winding when the deflection yoke is mounted on the in-line cathode ray tube.

* * * * *